US010969078B1

(12) United States Patent
Chae

(10) Patent No.: US 10,969,078 B1
(45) Date of Patent: Apr. 6, 2021

(54) LIGHT GUIDE DEVICE AND METHOD FOR SEQUENTIALLY LIGHTING LIGHT GUIDE DEVICE

(71) Applicant: HYUNDAI MOBIS CO., LTD., Seoul (KR)

(72) Inventor: Won Seok Chae, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 16/803,634

(22) Filed: Feb. 27, 2020

(30) Foreign Application Priority Data

Oct. 17, 2019 (KR) ..... 10-2019-0129127

(51) Int. Cl.

| | |
|---|---|
| ***F21S 43/14*** | (2018.01) |
| ***F21S 43/249*** | (2018.01) |
| ***F21S 43/239*** | (2018.01) |
| ***H05B 45/30*** | (2020.01) |

(52) U.S. Cl.
CPC ..... *F21S 43/14* (2018.01); *F21S 43/239* (2018.01); *F21S 43/249* (2018.01); *H05B 45/30* (2020.01)

(58) Field of Classification Search
CPC ..... F21S 43/249; F21S 43/239; H05B 45/30; G02F 1/133603; G02F 1/133606; G02F 1/133609; G02F 1/133611
See application file for complete search history.

(56) References Cited

U.S. PATENT DOCUMENTS

| | | | | |
|---|---|---|---|---|
| 7,077,556 | B2 * | 7/2006 | Sugiura | G02B 6/0028 362/615 |
| 7,810,982 | B2 * | 10/2010 | Parker | G02B 6/0021 362/620 |
| 9,911,901 | B2 * | 3/2018 | Lee | H01L 33/12 |
| 10,140,933 | B2 * | 11/2018 | Sako | G09G 3/3426 |

(Continued)

FOREIGN PATENT DOCUMENTS

| | | | |
|---|---|---|---|
| DE | 10 2018 213 399 | A1 | 2/2019 |
| EP | 2 787 276 | A1 | 10/2014 |
| KR | 10-2019-0076209 | A | 7/2019 |

OTHER PUBLICATIONS

Office Action dated May 29, 2020 in German Patent Application No. 102020103809.7 (6 pages).

*Primary Examiner* — Anabel Ton
(74) *Attorney, Agent, or Firm* — Knobbe Martens Olson & Bear LLP

(57) ABSTRACT

The present disclosure relates to a light guide device and a method for sequentially lighting the same. In one embodiment, the light guide device includes: a light guide including a light-emitting surface, light incident surfaces formed on both sides of the light-emitting surface and configured to receive light, and a light-reflecting surface formed opposite to the light-emitting surface and configured to reflect the received light to the light-emitting surface; a first light source unit and second light source unit disposed on the light-incident surfaces, respectively, and configured to irradiate light; and a light transmission control layer formed above the light-emitting surface and configured to control the transmittance of light emitted, wherein the light transmission control layer has a light transmittance which decreases from one end to the other end of the light transmission control layer.

10 Claims, 1 Drawing Sheet

(56) References Cited

U.S. PATENT DOCUMENTS

| | | | | |
|---|---|---|---|---|
| 2003/0090606 | A1* | 5/2003 | Lee | G02F 1/133615 349/65 |
| 2004/0141304 | A1* | 7/2004 | Nagakubo | G02F 1/133615 362/612 |
| 2006/0256580 | A1* | 11/2006 | Kang | G02B 6/0016 362/614 |
| 2007/0253080 | A1* | 11/2007 | Yokote | G02B 27/0994 359/833 |
| 2008/0192173 | A1* | 8/2008 | Itoh | G02B 6/0028 349/61 |
| 2008/0211990 | A1* | 9/2008 | Sakai | G02B 6/0078 349/64 |
| 2008/0212305 | A1* | 9/2008 | Kawana | G02F 1/133514 362/84 |
| 2013/0010486 | A1* | 1/2013 | Natsume | F21S 43/239 362/511 |
| 2013/0016526 | A1* | 1/2013 | McCollum | G02B 3/0068 362/607 |
| 2013/0258707 | A1* | 10/2013 | Iwasaki | G02B 6/0046 362/607 |
| 2019/0242546 | A1* | 8/2019 | Sakashita | B60Q 1/2607 |
| 2019/0346111 | A1* | 11/2019 | Kurschner | B60Q 1/525 |
| 2019/0353323 | A1* | 11/2019 | Furubayashi | B60Q 1/2607 |
| 2020/0132910 | A1* | 4/2020 | Matsushita | F21S 43/249 |

* cited by examiner

LIGHT GUIDE DEVICE AND METHOD FOR SEQUENTIALLY LIGHTING LIGHT GUIDE DEVICE

CROSS-REFERENCE TO RELATED APPLICATION

The present application claims priority under 35 U.S.C. § 119(a) to Korean Patent Application No. 10-2019-0129127, filed on Oct. 17, 2019 in the Korean Intellectual Property Office, which is incorporated herein by reference in its entirety.

BACKGROUND

1. Technical Field

Embodiments of the present disclosure relate to a light guide device and a method for sequentially lighting the same. More specifically, the present disclosure relates to a light guide device, which may produce a sequential lighting image and has excellent light uniformity, and a method for sequentially lighting the same.

2. Related Art

Various lamps are mounted in the front and rear of a vehicle to provide safety to the vehicle and the convenience of driving the vehicle. Recently, as the demand for the design of a vehicle has increased, vehicle lamps have been developed in various forms so that the aesthetics of the exterior of the vehicle could be improved.

In particular, a light guide device has recently been applied, which exhibits an indirect lighting effect by reflecting the light transmitted from a light source without directly exposing the light source, which emits light, to a lamp. The light guide device is mainly mounted on the edge portion of a vehicle lamp bezel, and light emitted from the light source is incident into the light guide device and emitted through a light-emitting surface. The application of this light guide device makes it possible to achieve excellent light uniformity and produce a lighting image having an excellent three-dimensional effect and anesthetics.

Meanwhile, as luxury vehicles have been demanded, studies have been conducted to make a vehicle lamp design and a lighting image more luxurious. In connection with this, attention has been paid to technology related to the production of the sequential lighting image of a vehicle lamp. The sequential lighting image of a conventional vehicle lamp was produced using a method that sequentially lights the vehicle lamp by irradiating light directly onto, for example, a light-emitting surface, using a plurality of light sources such as light-emitting diodes. However, when this direct lighting method using the plurality of light sources was applied, problems arose in that light uniformity was lowered and hot spots occurred, making it difficult to produce a uniform lighting image. However, a light guide device produces a uniform lighting image, but has a problem in that it is difficult to produce this sequential lighting image, because it uses the total reflection of light.

Background art related to the present disclosure is disclosed in Korean Patent Application Laid-Open No. 2019-0076209 (published on Jul. 2, 2019; entitled "Light-Emitting Display Device").

SUMMARY

One object of the present disclosure is to provide a light guide device which may produce a sequential lighting image and has excellent light uniformity.

Another object of the present disclosure is to provide a light guide device having excellent productivity and economic efficiency.

Still another object of the present disclosure is to provide a method for sequentially lighting the light guide device.

One aspect of the present disclosure is directed to a light guide device. In one embodiment, the light guide device includes: a light guide including a light-emitting surface, light incident surfaces formed on both sides of the light-emitting surface and configured to receive light, and a light-reflecting surface formed opposite to the light-emitting surface and configured to reflect the received light to the light-emitting surface; a first light source unit and second light source unit disposed on the light-incident surfaces, respectively, and configured to irradiate light; and a light transmission control layer formed above the light-emitting surface and configured to control the transmittance of light emitted, wherein the light transmission control layer has a light transmittance which decreases from one end to the other end of the light transmission control layer.

In one embodiment, each of the first light source unit and the second light source unit may include a substrate including a light source and a driving integrated circuit electrically connected to the light source and configured to supply a driving current to the light source.

In one embodiment, the light source may include a flip chip-type light-emitting diode.

In one embodiment, the light transmission control layer may be disposed to be spaced apart from the light guide.

In one embodiment, the light transmission control layer may have a thickness which increases from one end to the other end thereof.

In one embodiment, the light transmission control layer may have a triangular or trapezoidal sectional shape.

In one embodiment, the light transmission control layer may have a right triangular sectional shape such that the upper surface thereof is parallel to the light-emitting surface of the light guide and the lower surface thereof is formed to be inclined with respect to the light-emitting surface.

In one embodiment, the lower surface of the light transmission control layer may have irregularities formed thereon.

In one embodiment, the light transmission control layer may include a resin matrix and a light transmission control agent dispersed in the resin matrix.

In one embodiment, the resin matrix may include one or more of polycarbonate, polystyrene, an acrylonitrile-butadiene-styrene copolymer, polyolefin, polyester, and polyalkyl (meth)acrylate, and the light transmission control agent may include one or more of dyes and pigments.

Another aspect of the present disclosure is directed to a method for sequentially lighting the light guide device. In one embodiment, the method for sequentially lighting the light guide device includes: driving the first light source of the light guide device; increasing the brightness of the first light source to a target value by increasing the amount of a driving current which is supplied to the first light source; and driving the second light source at a time point when the brightness of the first light source reaches the target value.

The application of the light guide device according to the present disclosure may provide excellent light uniformity, produce a sequential lighting image, and provide excellent productivity and economic efficiency.

DETAILED DESCRIPTION

Hereinafter, the configuration and effects of the present disclosure will be described in more detail with reference to preferred examples. However, these examples are presented as preferred examples of the present disclosure and may not be construed as limiting the scope of the present disclosure in any way. The contents that are not described herein can be sufficiently and technically envisioned by those skilled in the art, and thus the description thereof will be omitted herein.

In the following description, the detailed description of related known technology or configurations will be omitted when it may obscure the subject matter of the present disclosure.

In addition, the terms used in the following description are terms defined in consideration of their functions in the present disclosure, may be changed in accordance with the intention of a user or operator or a usual practice. Thus, the definitions of these terms may be made based on the contents throughout the present specification.

In the present specification, "upper" and "lower" are defined with reference to the accompanying drawings, and according to a viewpoint, "upper" may be changed to "lower" and "lower" may be changed to "upper". When an element or layer is referred to as being disposed "on" another element or layer, it refer to not only a case where the element or layer is formed directly on another element or layer but also a case where an intervening structure exists.

Light Guide Device

Figure 1:
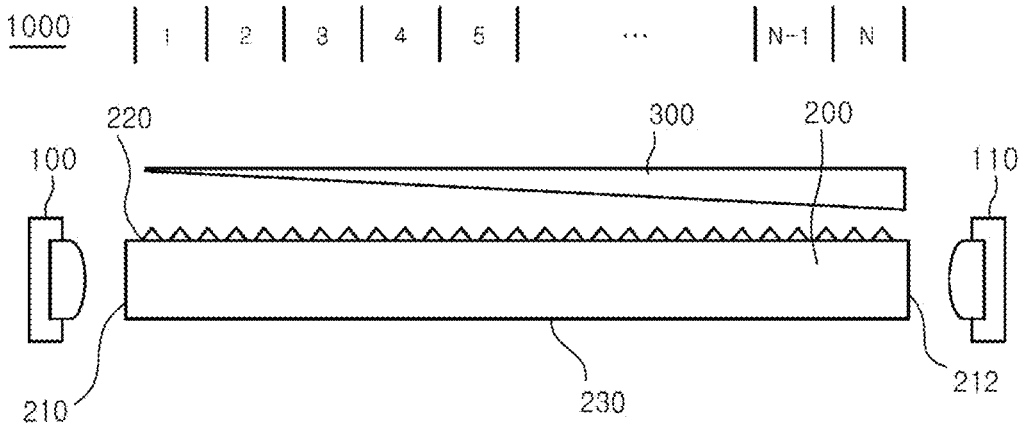
FIG. 1 illustrates a light guide device according to one embodiment of the present disclosure.

One aspect of the present disclosure is directed to a light guide device. FIG. 1 illustrates a light guide device according to one embodiment of the present disclosure. Referring to FIG. 1, a light guide device 1000 includes: a light guide 200 including a light-emitting surface 220, light incident surfaces 210 and 212 formed on both sides of the light-emitting surface 220 and configured to receive light, and a light-reflecting surface 230 formed opposite to the light-emitting surface 220 and configured to reflect the received light to the light-emitting surface 220; a first light source unit 100 and second light source unit 110 disposed on the light-incident surfaces 210 and 212, respectively, and configured to irradiate light; and a light transmission control layer 300 formed above the light-emitting surface 220 and configured to control the transmittance of light emitted, wherein the light transmission control layer 300 has a light transmittance which decreases from one end to the other end thereof.

The light-reflecting surface 230 may be formed by a conventional method. For example, it may be formed by depositing metals including nickel (Ni) and aluminum (Al) on one surface of the light guide.

In one embodiment, the first light source unit 100 and the second light source unit 110 may be disposed in contact with the light incident surfaces 210 and 212, respectively. In another example, as shown in FIG. 1, the first light source unit 100 and the second light source unit 110 may be disposed may be disposed to be spaced apart from the light incident surfaces 210 and 212.

In one embodiment, the light transmission control layer may have a thickness which increases from one end to the other end thereof. When the light transmission control layer is formed to satisfy this condition, the transmittance of light emitted from the light-emitting surface may decrease from one end to the other end of the light transmission control layer, making it easy to produce a sequential lighting image. For example, as shown in FIG. 1, the light transmission control layer 300 may have a thickness which increases gradually from one end to the other end thereof.

In one embodiment, the light transmission control layer may have a triangular or trapezoidal sectional shape.

Referring to FIG. 1, the light transmission control layer 300 may have a thickness which increases from one end to the other end thereof, and have a right triangular sectional shape such that the upper surface thereof is parallel to the light-emitting surface of the light guide and the lower surface thereof is formed to be inclined with respect to the light-emitting surface.

In one embodiment, the lower surface of the light transmission control layer 300 may have irregularities (not shown) formed thereon. When the irregularities are formed, light uniformity may be excellent. For example, the irregularities may have a surface roughness (Ra) of about 5 μm or more. Within this surface roughness range, light uniformity may be excellent. For example, the irregularities may have a surface roughness (Ra) of about 5 μm to about 500 μm.

For example, as shown in FIG. 1, the light transmission control layer 300 may be disposed to be spaced apart from the light guide 200. Under this condition, a sequential lighting image may be easily produced.

For example, the light transmission control layer 300 may be divided into n zones, and may have a light transmittance which decreases from one side of the light-emitting surface toward a first zone, a second zone, a third zone, . . . an n−1 zone and an $n^{th}$ zone. When the light transmittance decreases as described above, the sequential lighting of the light source units may be possible.

In one embodiment, the light transmission control layer may control light transmittance by controlling the degree of integration of dot images or the thickness of an anti-transmission material.

The light transmission control layer may be formed using various materials depending on a desired sequential lighting image. In one embodiment, the light transmission control layer 300 may include a resin matrix and a light transmission control agent dispersed in the resin matrix.

In one embodiment, the matrix resin may include one or more of polycarbonate, polystyrene, an acrylonitrile-butadiene-styrene copolymer, polyolefin, polyester, and polyalkyl (meth)acrylate, and the light transmission control agent may include one or more of dyes and pigments.

In one embodiment, the light transmission control agent may include a black pigment. The black pigment that is used in the present disclosure may be a conventional black pigment. For example, the black pigment may include one or more of aniline black, perylene black, titanium black and carbon black.

For example, the light transmission control layer may contain 100 parts by weight of the matrix resin and about 0.01 parts by weight to about 80 parts by weight of the light transmission control agent. Within this content range, the dispersibility of the light transmission control agent and the mechanical properties of the light transmission control layer may be excellent. For example, the light transmission control layer may contain 100 parts by weight of the matrix resin and about 5 parts by weight to about 30 parts by weight of the light transmission control agent.

When only elements that control the currents for driving the first light source and the second light source according to the present disclosure are applied, it may be difficult to produce a sequential lighting image, due to the nature of the light guide that emits light from the light-emitting surface using the total reflection of the light-reflecting surface. On the other hand, the application of the specific light transmission control layer according to the present disclosure may easily produce a sequential lighting image.

For example, upon sequential lighting, the light transmittance of the other end of the light guide is low due to the light transmission control layer, making it difficult to emit light. For this reason, after light emission from the first light source reaches a target value, light emission from the second light source at the other end may be made. In this case, the entire light-emitting surface of the light guide may emit light.

In one embodiment, each of the first light source unit and the second light source unit may include a substrate including a light source and a driving integrated circuit electrically connected to the light source and configured to supply a driving current to the light source. In one embodiment, the light source may include a flip chip-type light-emitting diode (LED). When the light source includes the flip chip-type light-emitting diode, luminous efficiency and light uniformity may be excellent.

Method for Sequentially Lighting Light Guide Device

Another aspect of the present disclosure is directed to a method for sequentially lighting the light guide device. In one embodiment, the method for sequentially lighting the light guide device includes the steps of: (S10) driving the first light source of the light guide device; (S20) increasing the brightness of the first light source to a target value by increasing the amount of a driving current which is supplied to the first light source; and (S30) driving the second light source at a time point when the brightness of the first light source reaches the target value.

In one embodiment, after driving the second light source, the amount of the driving current may increase to the target value, and at this time, the first light source may continue to be maintained at the target brightness value. Under such conditions, a sequential lighting image may be easily produced.

For example, the target brightness value may refer to the maximum brightness value of the first light source and the second light source.

Hereinafter, the configuration and effects of the present disclosure will be described in more detail with reference to a preferred example. However, this example is presented as a preferred example of the present disclosure and may not be construed as limiting the scope of the present disclosure in any way. The contents that are not described herein can be sufficiently and technically envisioned by those skilled in the art, and thus the description thereof will be omitted herein.

Example

A light guide device 1000 shown in FIG. 1 was prepared. Specifically, the light guide device 1000 was prepared, including: a light guide 200 including a light-emitting surface 220, light incident surfaces 210 and 212 formed on both sides of the light-emitting surface 220 and configured to receive light, and a light-reflecting surface 230 formed opposite to the light-emitting surface 220 and configured to the reflect the received light to the light-emitting surface 220; a first light source unit 100 and second light source unit 110 disposed on the light incident surfaces 210 and 212, respectively, and configured to irradiate light; and a light transmission control layer 300 disposed above the light-emitting surface and configured to control the transmittance of light emitted from the light-emitting surface 220, wherein the light transmission control layer 300 has a thickness, which gradually increases from one end (the position of the first light source unit) to the other end (the position of the second light source unit) thereof, and a light transmittance which decreases from the one end to the other end thereof. Each of the first light source unit and the second light source unit included a substrate including a light source (a flip chip-type light-emitting diode) and a driving integrated circuit electrically connected to the light source and configured to supply a driving current to the light source.

Figure 2:
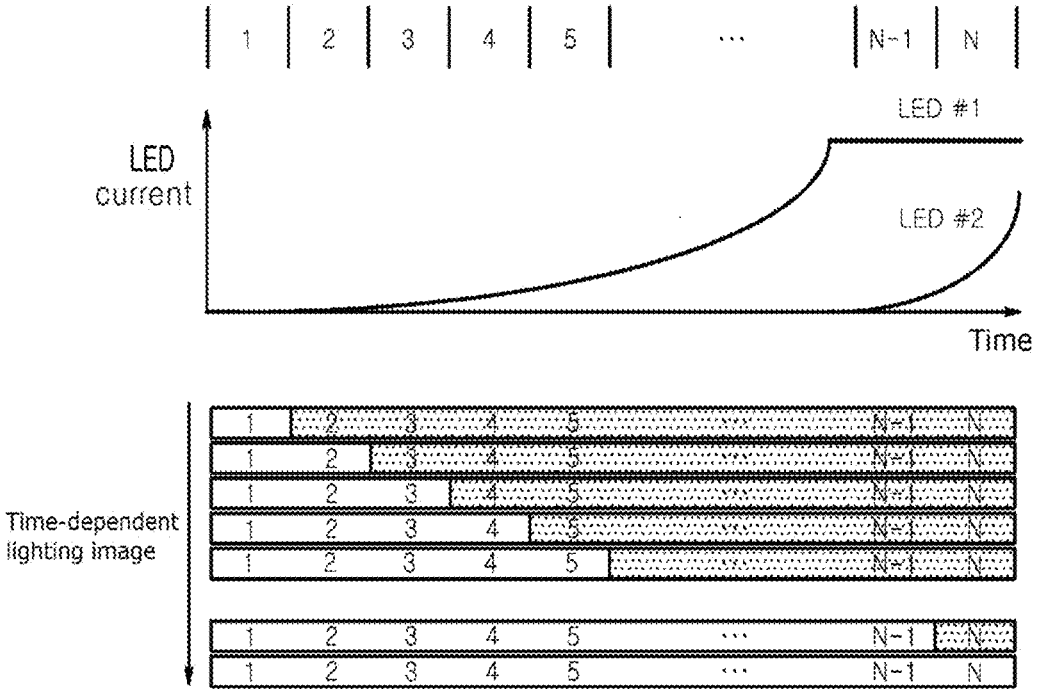
FIG. 2 illustrates a method for sequentially lighting a light guide device according to one embodiment of the present disclosure.

FIG. 2 illustrates a method of sequentially lighting a light guide device according to one embodiment of the present disclosure. As shown in FIG. 2, the first light source of the light guide device of the present disclosure was driven, and the brightness of the first light source was increased to a target value by increasing the amount of a driving current supplied to the first light source, and then continued to be maintained at the target value. Thereafter, at the time point when the brightness of the first light source reached the target value, the second light source was driven and the brightness of the second light source was increased to the target value by increasing the amount of a driving current supplied to the second light source.

As shown in FIG. 2, it could be seen that when the light transmission control layer 300 was divided into a first zone, a second zone, . . . . , an n−1 zone and an $n^{th}$ zone from one side of the light-emitting surface, the light guide device was sequentially lighted and had excellent light uniformity, suggesting that hot spots or the like did not occur.

Simple modifications or variations of the present disclosure may be easily carried out by those skilled in the art, and all such modifications or variations can be considered included in the scope of the present disclosure.

What is claimed is:

1. A light guide device comprising:

a light guide comprising a light-emitting surface, light-incident surfaces formed on both sides of the light-emitting surface and configured to receive light, and a light-reflecting surface formed opposite to the light-emitting surface and configured to reflect the received light to the light-emitting surface;

a first light source unit and second light source unit disposed on the light-incident surfaces, respectively, and configured to irradiate light; and a light transmission control layer formed above the light-emitting surface and configured to control the transmittance of light emitted, wherein the light transmission control layer has a light transmittance which decreases from a first end to a second end of the light transmission control layer, wherein the light transmission control layer has a thickness which increases from the first end to the second end of the light transmission control layer.

2. The light guide device of claim 1, wherein each of the first light source unit and the second light source unit comprises a substrate comprising a light source and a driving integrated circuit electrically connected to the light source and configured to supply a driving current to the light source.

3. The light guide device of claim 2, wherein the light source comprises a flip chip-type light-emitting diode.

4. The light guide device of claim 1, wherein the light transmission control layer is disposed to be spaced apart from the light guide.

5. The light guide device of claim 1, wherein the light transmission control layer has a triangular or trapezoidal sectional shape.

6. The light guide device of claim 5, wherein the light transmission control layer has a right triangular sectional shape such that an upper surface thereof is parallel to the light-emitting surface of the light guide and a lower surface thereof is formed to be inclined with respect to the light-emitting surface.

7. The light guide device of claim 6, wherein the lower surface of the light transmission control layer has irregularities formed thereon.

8. A light guide device comprising:

a light guide comprising a light-emitting surface, light-incident surfaces formed on both sides of the light-emitting surface and configured to receive light, and a light-reflecting surface formed opposite to the light-emitting surface and configured to reflect the received light to the light-emitting surface;

a first light source unit and second light source unit disposed on the light-incident surfaces, respectively, and configured to irradiate light; and a light transmission control layer formed above the light-emitting surface and configured to control the transmittance of light emitted, wherein the light transmission control layer has a light transmittance which decreases from one end to the other end of the light transmission control layer, wherein the light transmission control layer comprises a resin matrix and a light transmission control agent dispersed in the resin matrix.

9. The light guide device of claim 8, wherein the resin matrix comprises one or more of polycarbonate, polystyrene, an acrylonitrile-butadiene-styrene copolymer, polyolefin, polyester, and polyalkyl (meth)acrylate, and the light transmission control agent comprises one or more of dyes and pigments.

10. A method for sequentially lighting the light guide device of claim 1, the method comprising:

driving the first light source unit of the light guide device;

increasing a brightness of the first light source unit to a target value by increasing an amount of a driving current which is supplied to the first light source unit; and driving the second light source unit at a time point when the brightness of the first light source unit reaches the target value.

* * * * *